US005431877A

United States Patent [19]

Brücken et al.

[11] Patent Number: 5,431,877

[45] Date of Patent: Jul. 11, 1995

[54] PROCESS FOR DECREASING THE CORROSIVENESS OF A SOUR WATER

[75] Inventors: Volker Brücken, Eschborn; Gert Ungar, Frankfurt am Main; Hans-Martin Stönner, Eschborn; Ernst Stöldt, Heppenheim; Johann Schlauer, Frankfurt am Main; Nikola Anastasijevic, Schöneck; Eilhard Hillrichs, Büdingen, all of Germany

[73] Assignee: Metallgesellschaft Aktiengesellschaft, Frankfurt am Main, Germany

[21] Appl. No.: 205,523

[22] Filed: Mar. 2, 1994

[51] Int. Cl.[6] ..... C23F 11/00

[52] U.S. Cl. ..... 422/7; 204/92; 204/149; 204/151; 210/758; 210/765; 210/904; 422/12

[58] Field of Search ..... 422/7, 12; 210/752, 210/757, 758, 765, 904; 204/149, 151, 152, 92, 102

[56] References Cited

U.S. PATENT DOCUMENTS 3,249,522 5/1966 Bolmer .
3,409,520 11/1968 Bolmer .
4,508,683 4/1985 Doll et al. ..... 422/7
4,765,873 8/1988 Chang et al. ..... 204/101

FOREIGN PATENT DOCUMENTS 0226415 6/1987 European Pat. Off. .

*Primary Examiner*—Robert J. Warden
*Assistant Examiner*—Krisanne M. Thornton
*Attorney, Agent, or Firm*—Herbert Dubno; Jonathan Myers

[57] ABSTRACT

An aqueous solution which contains ammonium polysulfide is proportionally added to the sour water, which contains cyanide ions, ammonium ions, and sulfide ions. At least part of the cyanide ions contained in the sour water is converted to thiocyanate ions by the ammonium polysulfide. The solution which contains ammonium polysulfide is prepared from an aqueous solution by oxidation in an electrochemical cell. That aqueous solution may consist entirely or in part of sour water.

7 Claims, 1 Drawing Sheet

PROCESS FOR DECREASING THE CORROSIVENESS OF A SOUR WATER

FIELD OF THE INVENTION

The present invention relates to a process for decreasing the corrosiveness of a sour water which is being treated or handled in a plant and contains cyanide ions ($CN^-$), ammonium ions ($NH_4^+$), and sulfide ions ($S^{--}$), wherein an aqueous solution which contains ammonium polysulfide (APS) is proportionally added to the sour water in the plant and at least part of the cyanide ions is converted to thiocyanate ions ($SCN^-$).

BACKGROUND OF THE INVENTION

A process wherein ammonium polysulfide is added to a sour water to convert cyanide was to thiocyanate ions has been described in U.S. Pat. No. 4,508,683 and in "Hydrocarbon Processing" (July 1981), p. 149–155. Those portions of the plant which are endangered by corrosion are supplied with an APS solution from a supply tank but there is no information how the APS solution is produced.

OBJECTS OF THE INVENTION

It is therefore an object of the present invention to provide an improved process for decreasing the corrosiveness of a sour water at minimum costs enabling production of the APS solution adjacent to the plant itself.

Another object is the provision of such an improved process for producing ammonium polysulfide in conjunction with the reduction of the corrosivity of sour water whereby significant advantages are gained.

SUMMARY OF THE INVENTION

This is accomplished in accordance with the invention in that the APS solution is oxidatively prepared in an electro-chemical cell from an aqueous solution which contains ammonium ions and sulfide ions and the electrochemical cell is supplied with sour water which has been withdrawn from the plant.

In the process of the invention the aqueous solution which is supplied to the electrochemical cell for producing APS can be formed entirely or in part from sour water which is present in the plant. That aqueous solution in most cases comprises 30 to 100% sour water which comes from the plant.

The electrochemical cell is suitably supplied with an aqueous solution which contains ammonium ions, calculated as $NH_3$, in an amount of at least 1 g/l, and which contains sulfide ions, calculated as $H_2S$, in an amount of 1 to 200 g/l, preferably at least 20 g/l. The electrochemical cell can comprise a membrane cell containing a cation exchanger membrane between the catholyte and anolyte.

Instead of the cation exchange membrane, a microporous membrane or a diaphragm consisting, for example, of polypropylene or polyvinylidene difluoride may be used.

Alternatively, the electrochemical cell may have no membrane or diaphragm. In that case the cathode material and the cell geometry will be so selected that the APS which has been formed at the anode will not be reduced at the cathode.

In the electrochemical cell the APS solution is formed at the anode by the oxidation of ammonium sulfide ($(NH_4)_2S$) to ammonium polysulfide ($(NH_4)_2S_x$), wherein x is in the range from 2 to 6.

The solution employed in the anode compartment may also be used as a catholyte or the catholyte may consist of aqueous alkaline solutions, e.g., of NaCH, $NH_4OH$, $Na_2SO_4$, $Na_2CO_3$ or mixtures thereof. A pH from 9 to 14 is preferred.

Materials which may be used to make the anode or cathode include graphite, nickel or special steel. The cell voltage is approximately in the range from 1 to 5 volts and the current density may usually amount to 0.1 to 3 kA/m$^2$.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
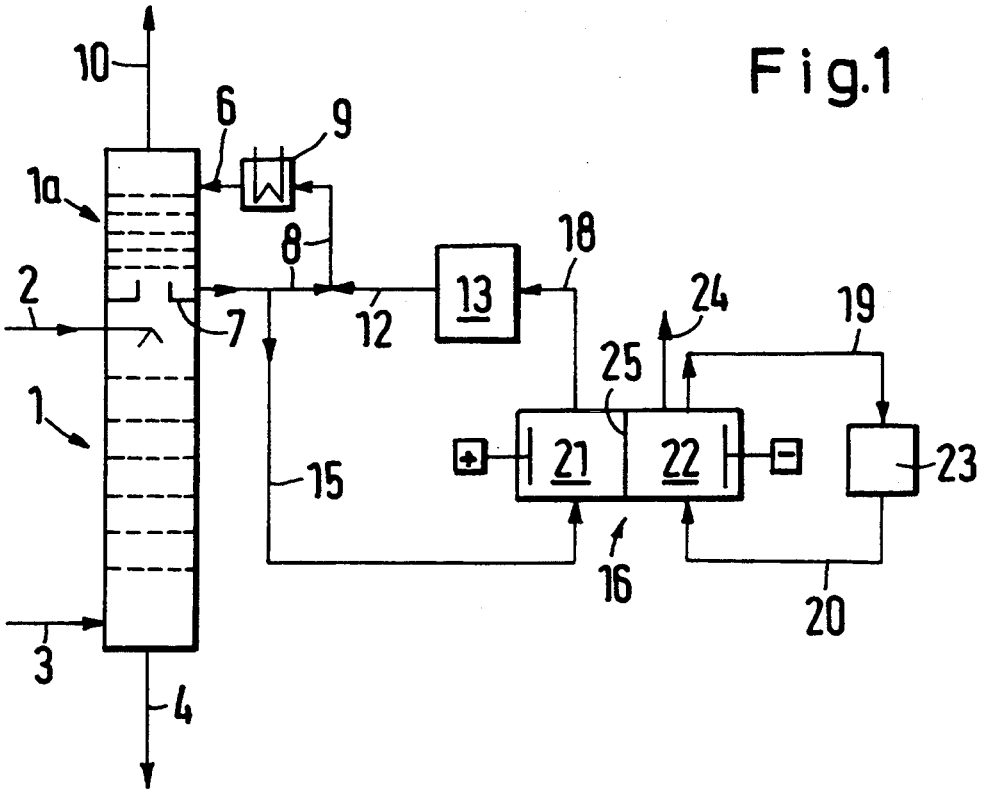
FIG. 1 is a flow diagram of the process according to the invention.

As seen in FIG. 1, the process is carried out in association with a stripping column 1, which comprises an upper part 1*a*, which is to be protected from corrosion. The sour water to be treated is supplied in line 2 and is stripped with steam from line 3. The steam which is used as a stripping fluid may alternatively be produced by reboiling in the sump of the column 1. The column contains conventional liquid-permeable plates or packing elements. Substantially purified water leaves the column 1 through line 4.

In the upper part l*a* of the column a cooling is effected by cooled circulated condensate, which is supplied in line 6. The condensate is withdrawn from the liquid-permeable plate 7 through the line 8 and, by a circulating pump, not shown, is caused to flow through the cooler 9 and to flow back through the line 6 to the top of the column. Exhaust gas flowing water vapor leaves the column 1 through line 10 and is processed by means which are not shown. Pumps have not been shown in the drawing so as to avoid obscuring the flow paths.

The sour water is distributed from the line 6 over the top part 1*a* of the column and is partly collected by the plate 7 and is circulated through the line 8 and the cooler 9 and contains cyanide ions, ammonium ions and sulfide ions in considerable concentrations and for this reason is highly corrosive to steel and even alloy steel.

To suppress such corrosion entirely or in part, the sour water is mixed with an aqueous APS solution, which is supplied through line 12 from the supply tank 13. The APS solution is prepared from sour water which has been branched from the line 8 through line 15 and supplied to the anode chamber 21 of an electrochemical cell 16, which is schematically indicated. Ammonium polysulfide (APS) is prepared in the anode chamber by electrochemical oxidation and as an aqueous solution is supplied through the line 18 to the supply tank 13.

The catholyte is circulated through the cathode chamber 22, the lines 19 and 20 and the intermediate tank 23. Hydrogen is formed in the cathode chamber 22 and is withdrawn in line 24. The anode chamber 21 may be separated from the cathode chamber 22 by a cation exchange membrane 25. The membrane 25 may be replaced by a liquid-permeable diaphragm and it is possible to use neither a membrane nor a diaphragm, i.e., to provide no flow-resisting means.

Figure 2:
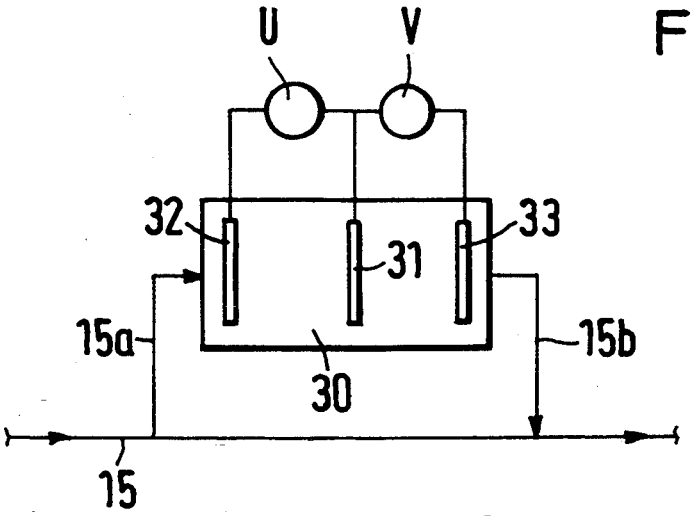
FIG. 2 is a diagram of a method of measuring the corrosiveness.

In a large plant, the supply tank 13 for the APS solution may be connected to a plurality of locations at which the ammonium polysulfide is proportionally added, as is known per se. The control of the proportional addition is illustrated in FIG. 2. The corrosiveness of the sour water can be measured as follows: A branch stream is branched from line 15—see also FIG. 1—through line 15*a* and is conducted through a measuring cell 30. The outflowing water is returned through line 15*b* to the main line 15.

The measuring cell 30 contains a reference electrode 31, a material electrode 32 and a platinum electrode 33. The reference electrode is, e.g., a calomel electrode, a mercury-mercury sulfate electrode, a silver-silver chloride electrode or a copper-copper sulfate electrode, which are known per se. The material electrode consists of the material, such as steel, the corrosion of which is to be suppressed in the plant. The potential between the reference electrode 31 and the material electrode 32 is measured by the voltmeter U. The potential between the reference electrode 31 and the platinum electrode 33 is measured by the voltmeter V.

Figure 3:
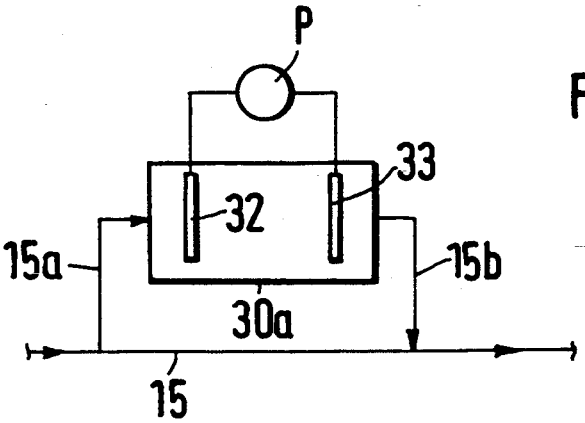
FIG. 3 is a diagram which illustrates a measuring method which is somewhat simpler than that of FIG. 2.

The resting potential of the system is measured by voltmeter U and the oxidation-reduction potential by voltmeter V. The potential difference V−U is a measure of the corrosiveness. In case of a rising potential difference, more APS solution must be proportionally added at the endangered point if a disturbing corrosion is to be prevented. The potential difference is used to control the production of the APS (concentration in the solution in line 18) or the rate of feed in line 12 to the circulating sour water. A corrosiveness indicator consisting of a measuring cell which is somewhat simpler than that of FIG. 2 is shown in FIG. 3. In that case the measuring cell 30*a* which is traversed by a branch stream of the sour water from line 15 contains only the material electrode 32 and the platinum electrode 33. The potential P measured between the electrodes is a measure of the corrosiveness of the liquid against the material and is used in the manner described.

SPECIFIC EXAMPLE

In a plant corresponding to that shown in FIG. 1 of the drawing, sour water at a temperature of 110° C. and under a pressure of 5 bars is supplied to a stripping column 1 through the line 2 at a rate of 30.517 kg/h. The sour water contains $NH_3$, $H_2S$ and HCN in the amounts stated in column A of the Table:

| | A | B | C |
|---|---|---|---|
| $NH_3$ (kg/h) | 171 | 1.5 | 6113 |
| $H_2S$ (kg/h) | 345 | 0.15 | 3858 |
| HCN (kg/h) | 1 | 0.03 | 0.8 |
| $SCN^-$ (kg/h) | — | 1.7 | 14 |

The stripping fluid consists of steam, which is supplied at 140° C. through line 3 at a rate of 5000 kg/h. The purified water in line 4 contains the pollutants in the residual amounts stated in column B. An aqueous solution at a temperature of 75° C. is supplied to the cooling portion la of the stripping column through line 6 at a rate of 82,000 kg/h. When APS solution has been added through line 12 to that aqueous solution, the latter contains substances in the amounts stated in column C.

The APS solution is prepared in a membrane electrolytic membrane cell, which is of the filter press type and contains a plate anode and a plate cathode made of graphite. The anode and cathode chambers are separated by a cation exchanger membrane (Nafion type 234 from DuPont). The catholyte consists of an aqueous solution of 15% $Na_2SO_4$, which contains 18% by weight $NH_3$ and is at a temperature of 50° C. and has a pH of 13. The catholyte is circulated as is shown in FIG. 1.

The anolyte consists of the above-mentioned sour water, a part of which is supplied through the line 15 to the cell 16 at a rate of 210 kg/h. The cell is operated at a current density of 1 kA/$m^2$ and at a cell voltage of 2.8 volts. Active sulfur at a rate of 5 kg/h is produced in the form of APS, which is proportionally added through lines 18 and 12 to the sour water in line 8.

Measurement of corrosiveness: In an experimental setup as shown in FIG. 2, sour water which is at a temperature of 60° C. is supplied to the measuring cell 30 at a rate of 10 l/h. That sour water is highly similar to the sour water described hereinbefore and contains the interesting components stated in the following table in the amounts stated in column A:

| | A | B |
|---|---|---|
| $CO_2$ | 13 g/kg | 13 g/kg |
| $NH_3$ (total) | 169 g/kg | 169 g/kg |
| $H_2S$ | 51 g/kg | 51 g/kg |
| HCN (total) | 93 mg/kg | 30 mg/kg |
| HCN (free) | 23 mg/kg | 30 mg/kg |
| active APS sulfur | — | 50 mg/kg |

The difference between HCN (total) and HCN (free) in column A is due to the fact that complex iron cyanide compounds have been formed as a result of corrosion. The material electrode 32 consists of stainless steel (German Material No. 1.4571, corresponding to the U.S. standard AISI 316 Ti) and the reference electrode 31 is a conventional Ag/AgCl electrode.

The following values are measured when no APS is added to the sour water: U=−630 mV, V=−475 mV, V−U=155 mV. The removal of material from the material electrode corresponds to a decrease of the thickness by 0.65 mm per year.

Sour water to which APS has been added contains the interesting components in the concentrations stated in column B of the above table. The APS solution is added in such an amount that the following values are obtained in the measuring cell: U=−490 mV, V=−475 mV, V−U=15 mV. In that case the decrease of the thickness of the material electrode drops below 0.01 mm per year.

We claim:

1. A process for decreasing corrosivity of a sour water, comprising the steps of:

(a) providing a plant sensitive to corrosion by sour water, said plant containing sour water having cyanide ions, ammonium ions, and sulfide ions therein; recycling a portion of said first stream as a second stream of sour water into said plant;

(b) withdrawing a first stream of said sour water from said plant sensitive to corrosion by the sour water and recycling a portion of said first stream as a second stream of sour water into said plant;

(c) supplying an electrolytic cell with a first aqueous solution as an electrolyte in said cell, said first aqueous solution containing at least 1 g/l of ammonium ions, calculated as $NH_3$, and 1 to 200 g/l of sulfide ions, calculated as $H_2S$, wherein 30% to 100% of said first aqueous solution is comprised of a remaining portion of said sour water of said first stream; and (d) electrochemically oxidizing said electrolyte in said electrolytic cell to produce a second aqueous solution containing ammonium polysulfide, withdrawing said second aqueous solution from said cell, and adding at least a portion of said second aqueous solution to said second stream of sour water recycled during step (b), so that said second stream of sour water contains ammonium polysulfide, which reduces the corrosivity of the sour water by conversion of at least a portion of the cyanide ions therein to thiocyanate ions.

2. The process defined in claim 1 wherein according to step (c) a corrosiveness of the remaining portion of the first stream of the sour water is determined by at least one potential measurement therein, further comprising the step of controlling addition of the ammonium polysulfide to the remaining portion of the first stream of the sour water in said plant in dependence upon said measurement.

3. The process defined in claim 1, further comprising the step of providing said cell as a membrane cell.

4. The process defined in claim 1, further comprising the step of providing said cell as a diaphragm cell.

5. The process defined in claim 1 wherein according to step (c) the remaining portion of the first stream of the sour water withdrawn from said plant is supplied to an anode compartment of said cell and an alkaline solution is supplied to a cathode compartment of said cell.

6. The process defined in claim 1, further comprising the step of providing said cell without a barrier between anode and cathode spaces thereof.

7. The process defined in claim 1, wherein according to step (c) said first aqueous solution comprising a remaining portion of said sour water is a sole source of sulfide ions for said plant.

* * * * *